United States Patent [19]

Cislak

[11] 4,223,618

[45] Sep. 23, 1980

[54] AUTOMATIC BOBBIN CHANGER AND APPARATUS FOR A SEWING MACHINE

[75] Inventor: Raymond S. Cislak, Chicago Heights, Ill.

[73] Assignee: Gateway Industries, Inc., Chicago, Ill.

[21] Appl. No.: 876,270

[22] Filed: Feb. 9, 1978

[51] Int. Cl.[2] ..... D05B 59/04; D05B 57/26

[52] U.S. Cl. ..... 112/186; 112/180

[58] Field of Search ..... 112/180, 186, 181, 196, 112/231

[56] References Cited

U.S. PATENT DOCUMENTS

| | | | |
|---|---|---|---|
| 2,298,871 | 10/1942 | Cumfer | 112/186 |
| 2,438,459 | 3/1948 | Sebell | 112/186 |
| 2,507,470 | 5/1950 | Hirsch | 112/181 |
| 2,733,676 | 2/1956 | Schumann et al. | 112/180 |
| 2,808,795 | 10/1957 | Wortham . | |
| 3,072,084 | 1/1963 | Vigorelli | 112/180 |
| 3,125,973 | 3/1964 | Bernerus et al. | 112/186 |
| 3,376,838 | 4/1968 | Schiffmacher et al. | 112/186 |
| 3,744,442 | 7/1973 | Michaels et al. | 112/186 |
| 3,747,547 | 7/1973 | Mayer et al. | 112/186 |
| 3,981,256 | 9/1976 | Sexton | 112/180 |

FOREIGN PATENT DOCUMENTS

| | | | |
|---|---|---|---|
| 1206713 | 12/1965 | Fed. Rep. of Germany | 112/186 |

*Primary Examiner*—Werner H. Schroeder
*Assistant Examiner*—Andrew M. Falik
*Attorney, Agent, or Firm*—Fitch, Even, Tabin, Flannery & Welsh

[57] ABSTRACT

An apparatus is disclosed for automatically substituting a fully threaded bobbin assembly for a used bobbin assembly in a thread shuttle of a sewing machine having the bobbin assembly latched to the thread shuttle. A pivoted hook unlatches the spent bobbin assembly from the thread shuttle and then a plunger extracts the spent bobbin assembly and places it in a magazine. The magazine carries a new and full thread bobbin assembly and the plunger transfers the full thread bobbin assembly into latched engagement with the thread shuttle. An electric control system including an automatic counter counts the number of sewing operations and after a predetermined number of sewing operations causes the automatic exchange of bobbin assemblies.

12 Claims, 12 Drawing Figures

AUTOMATIC BOBBIN CHANGER AND APPARATUS FOR A SEWING MACHINE

This invention relates to a bobbin changing apparatus for use with sewing machines to automatically substitute an unused bobbin carrying sewing thread for a used bobbin.

The present invention is directed to an automatic bobbin changing apparatus for use with sewing machines employing bobbin casings having a pivotally mounted latch thereon for latching engagement with a rotary thread shuttle of the sewing machine. Within the bobbin casing is disposed the spool-like bobbin on which is coiled a predetermined length of sewing thread. The leading end of the thread is threaded through a suitable eye in the bobbin casing. The bobbin and its bobbin casing, hereinafter termed a "bobbin assembly" are manually unloaded from and loaded into a commercially available industrial sewing machine made by Singer Sewing Machine Company. One such use for such industrial sewing machines is to sew plies of seat belts with a relatively heavy nylon thread which must resist breaking or unraveling under high load tensile forces which may ultimately be applied to the belt. Typically, the seat belts are made of woven nylon or polyester and are selectively thick compared to most cloth articles. To provide the requisite strength against failing at high tensile loading, the seat belts are formed with a strength stitch pattern having a large number of stitches. For instance, a butterfly stitch pattern having 168 stitches is often used to sew together overlapped portions of a seat belt forming a loop for the belt. Because a typical bobbin will have only sufficient thread for 10 such butterfly stitch patterns, relatively frequent manual replacements of the used bobbins is necessary.

In present practice, a machine operator manually counts the number of belts sewn; after sewing ten belts, the operator reaches into the sewing machine at a location beneath a work supporting table and a control cam to the latch on the bobbin casing. The operator picks the latch open and swings it outwardly from locking engagement with a central shaft of a rotary thread shuttle and then removes the bobbin assembly from the machine. The used bobbin is pulled and separated from the bobbin casing and the operator takes a new unused bobbin having a full coil thread thereon and places this bobbin into the bobbin casing. A piece of thread is pulled from the bobbin and is threaded through an eye opening on the bobbin casing. The operator then inserts the bobbin assembly with the loaded bobbin into the rotary thread shuttle and pivots the latch into locking engagement with the shuttle post. The operator is then ready to begin the next sewing operation.

Such a manual replacement of a used bobbin is time consuming for the reason that no belt is being sewn during the time that the operator is replacing the spent bobbin. Moreover, a manual system is subject to operator miscalculations whereby a substantially used bobbin may begin to sew an 11th belt before the operator realizes that a mistake has been made. Thus, there is a need for a more automatic and efficient method of changing the bobbin assemblies of the foregoing kind.

Accordingly, a general object of the present invention is to provide a new and improved bobbin changer apparatus for bobbins of the foregoing kind.

Other objects and advantages of the invention will become apparent from the following detailed description and drawings in which.

Figure 3:
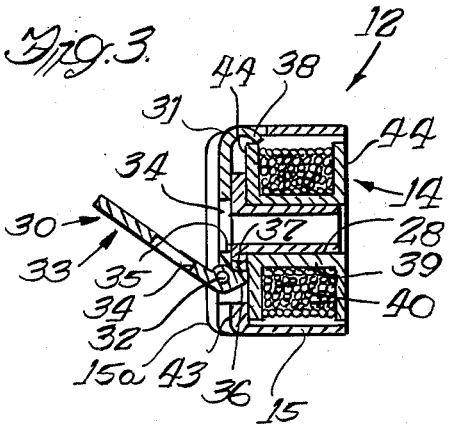
FIG. 3 is a cross-sectional view of a bobbin assembly.
Figure 3A:
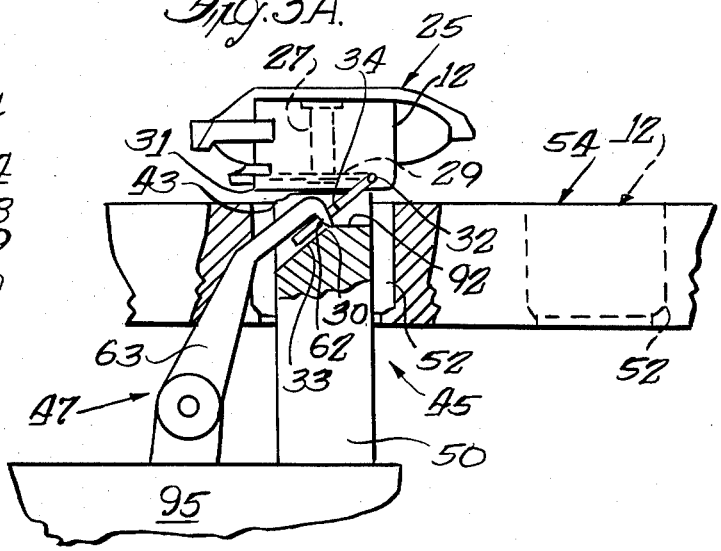

FIG. 3*a* is a diagrammatic view of the bobbin assembly and the unlatching and extracting mechanisms.

Figure 4:
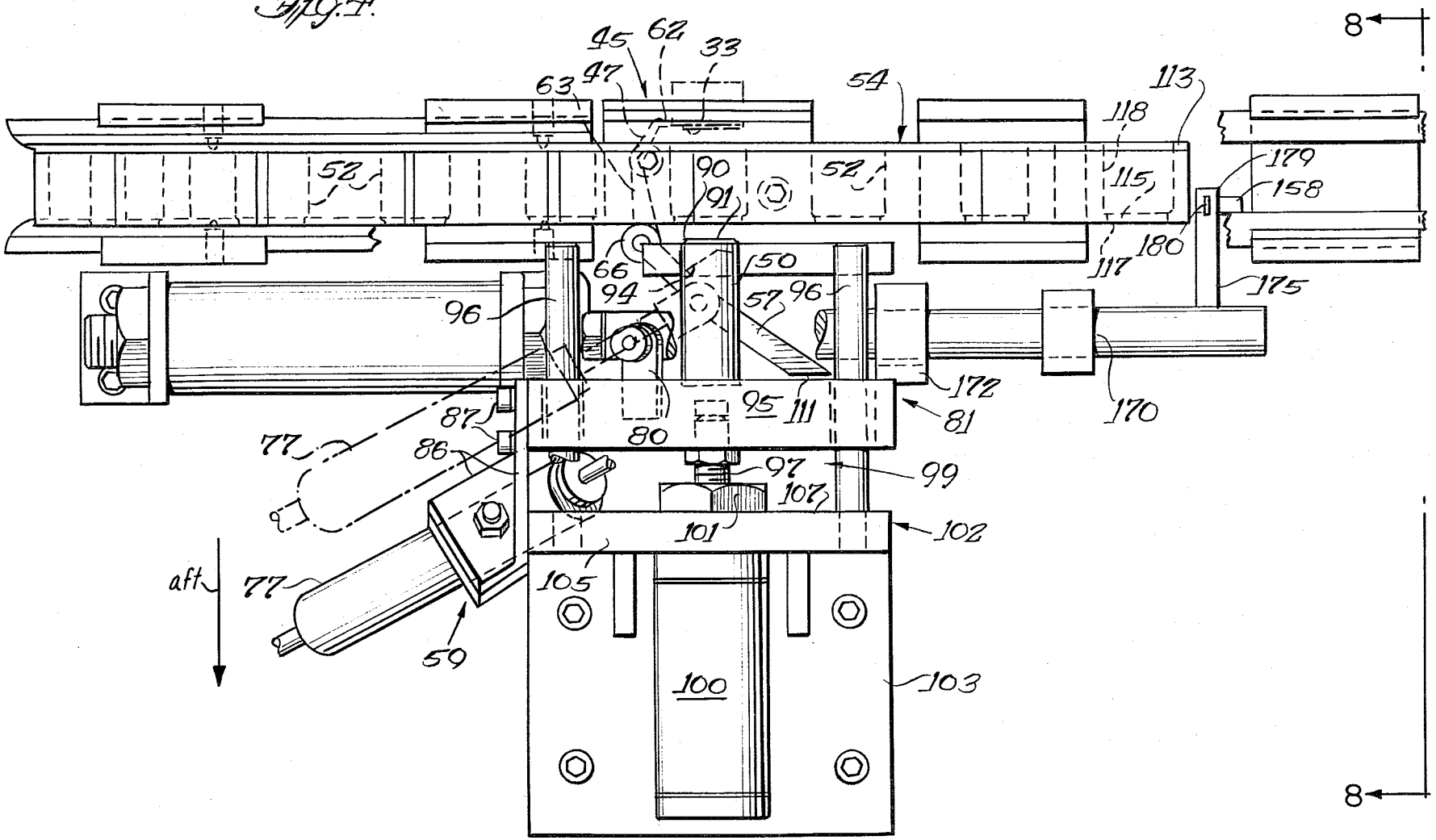

FIG. 4 is a plan view of a bobbin assembly changing apparatus constructed in accordance with the preferred embodiment of the invention.

Figure 5:
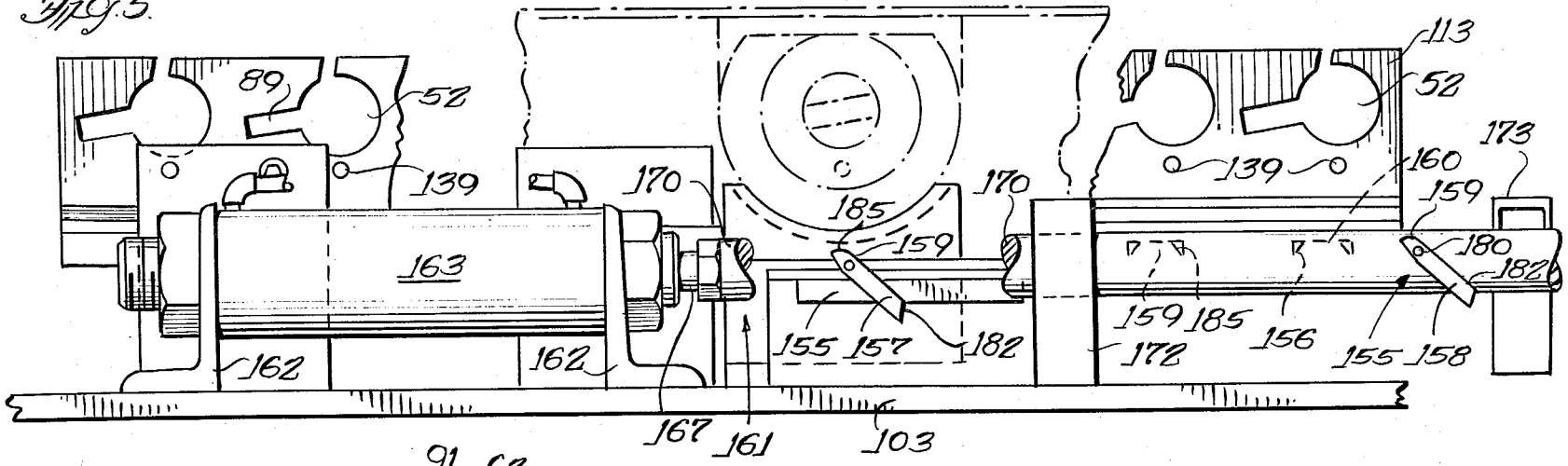

FIG. 5 is an elevational view of the bobbin assembly changing apparatus.

Figure 6:
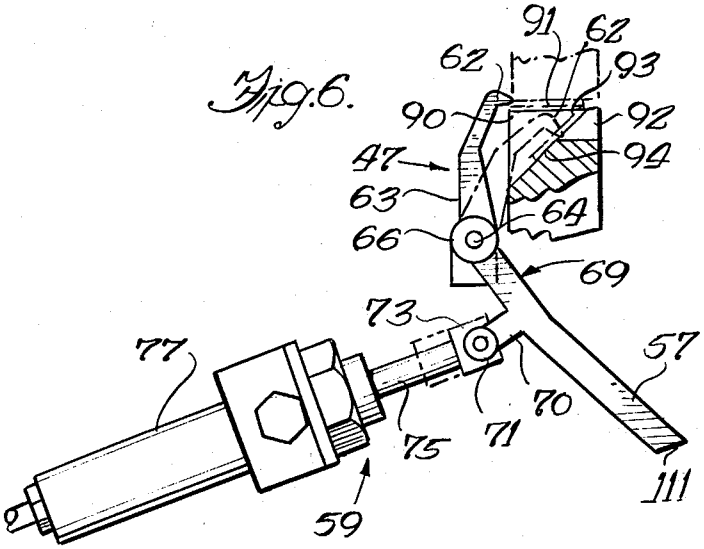

FIG. 6 is a diagrammatic view of the means for unlatching and gripping the bobbin casing.

Figure 7:
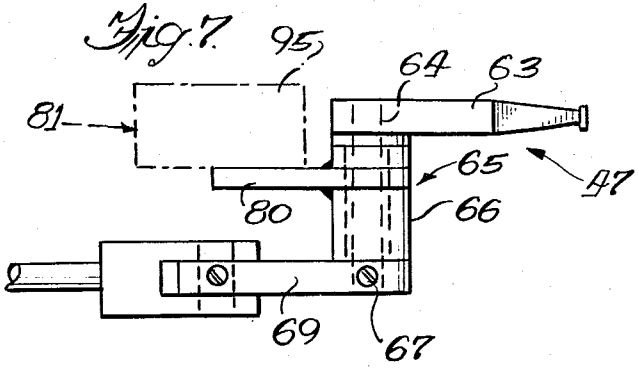

FIG. 7 is a fragmentary view of the latching lever means.

Figures 8, 9, 10:
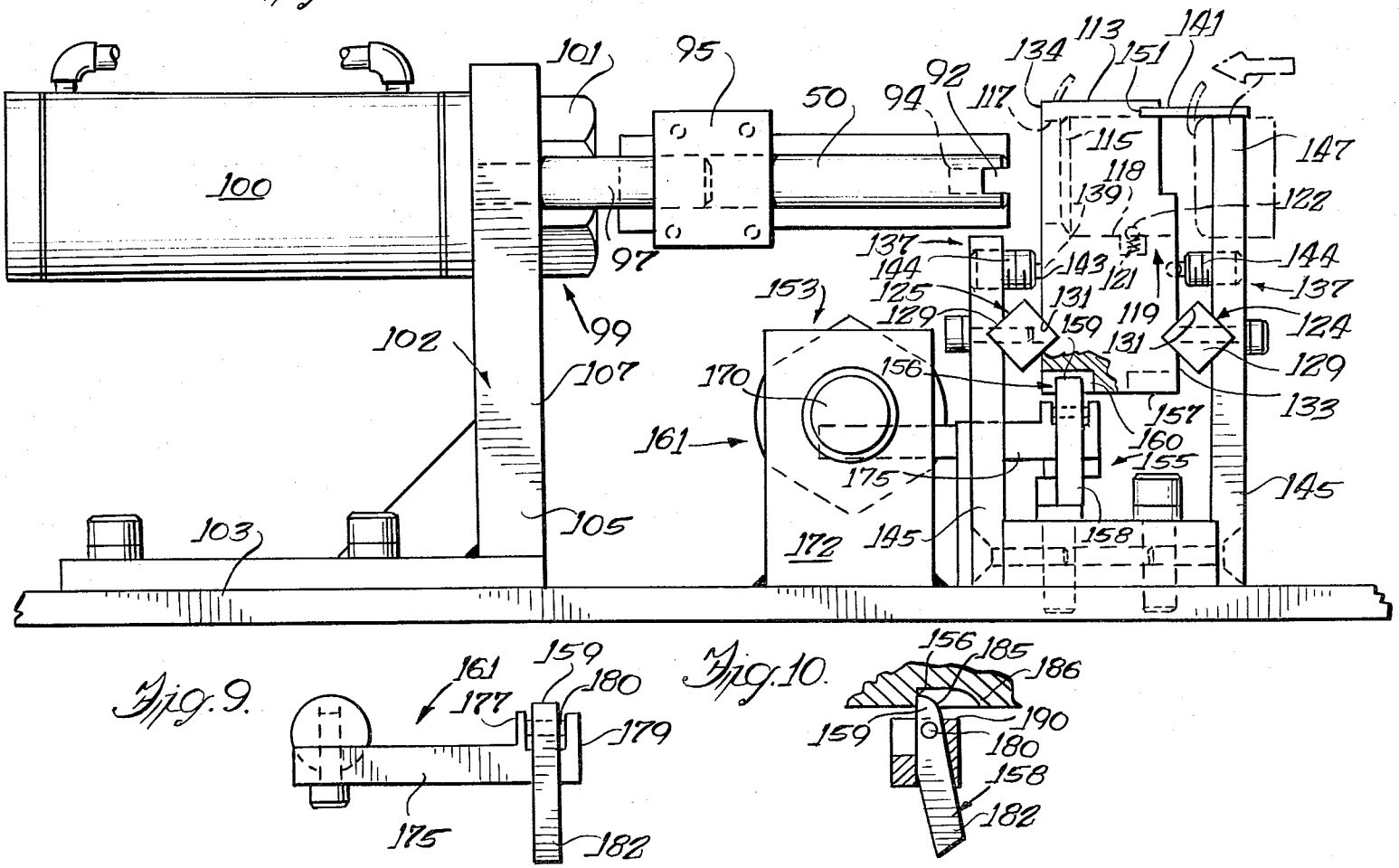

FIG. 8 is a side view of the bobbin exchanging apparatus.

FIG. 9 illustrates a pawl carrier means.

FIG. 10 is a fragmentary view of the pawl means; and

Figure 11:
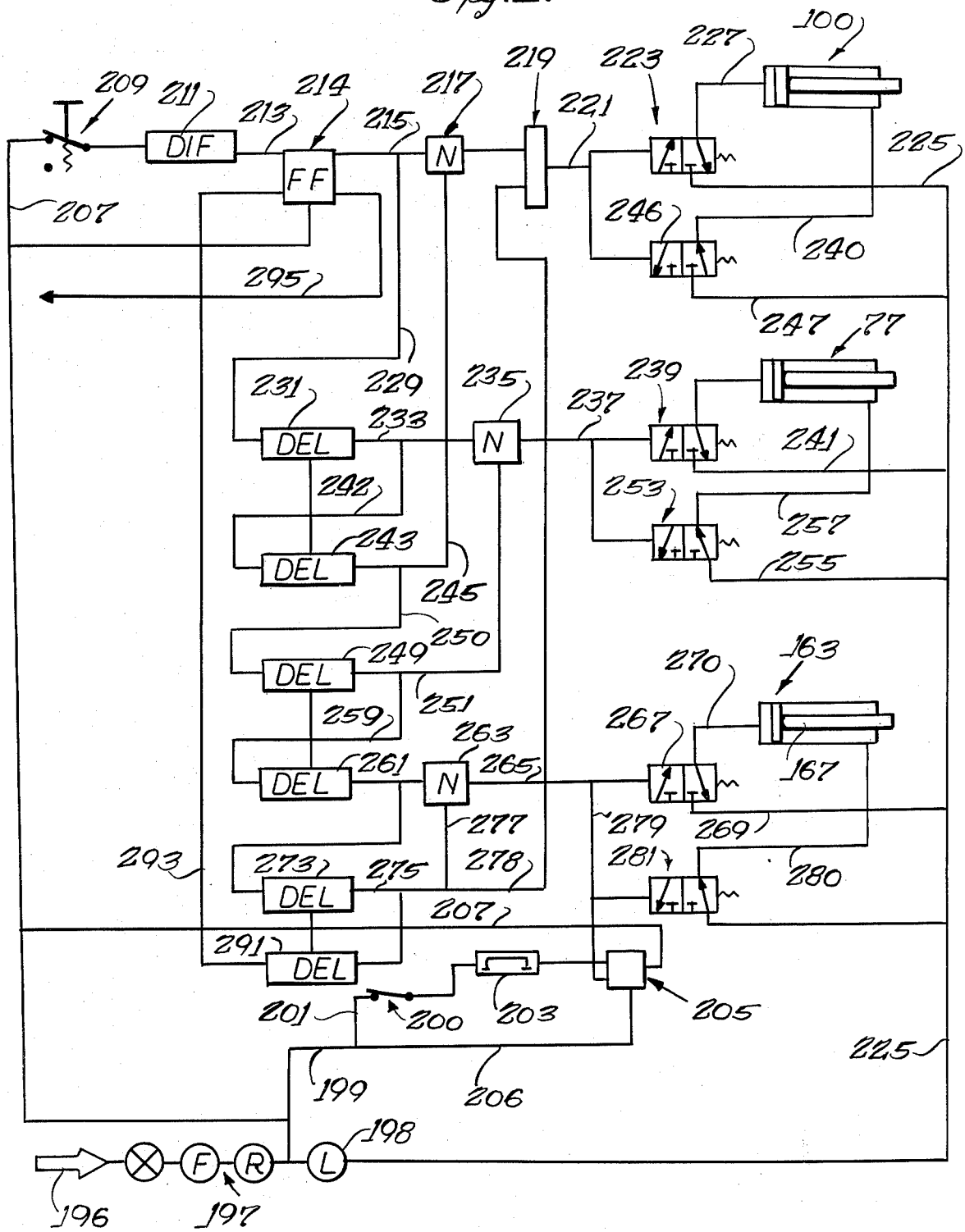

FIG. 11 is a schematic view of a control circuit means for the bobbin changing apparatus.

Figure 1:
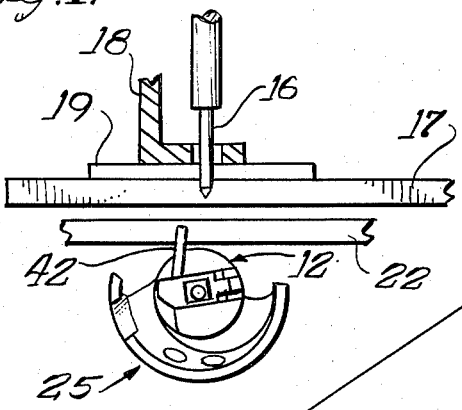
FIG. 1 is a diagrammatic view of a conventional sewing machine having a bobbin assembly.
Figure 1:
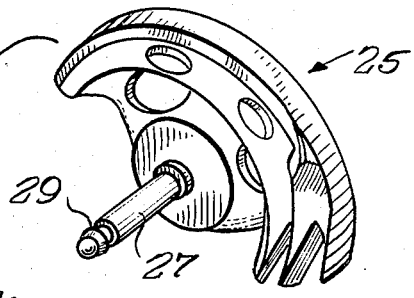
Figure 2:
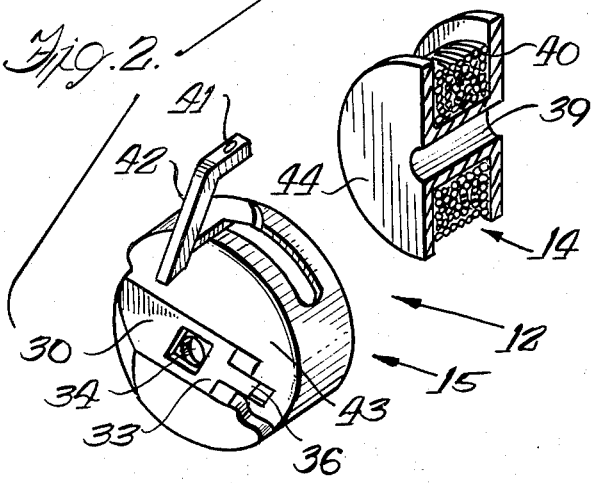
FIG. 2 is an exploded perspective view of the bobbin assembly and the thread shuttle therefor.

As shown in the drawings for purposes of illustration, the invention is embodied in a bobbin changing apparatus 11 (FIGS. 4–11) for use with a sewing machine to change a bobbin assembly 12 comprising an interior thread-carrying bobbin 14 and a bobbin casing 15 holding the bobbin 14 (FIGS. 2 and 3). Bobbin assembly 12 is mounted beneath a sewing needle 16 of a conventional industrial sewing machine. The workpiece which in this instance is a seat belt 19 carried on the top of a flat top plate 17 is shifted by a linearly shifting workpiece shuttle 18 along the top plate and relative to the vertically reciprocating needle 16 to form the desired stitch. The shifting movement of the workpiece shuttle and seat belt is controlled by a large rotary cam 22 located beneath the top plate 17 and above as oscillating thread shuttle 25. The oscillating thread shuttle 25 is located beneath the cam 22 and is a driven part of the sewing machine and receives the bobbin assembly 12 to supply thread 40 for the sewing operation. The illustrated cam 22, work piece shuttle 18, and the oscillating thread shuttle 25 are conventional devices on industrial sewing machines and hence will be only briefly described. The illustrated bobbin assembly 12 is also a conventional and well known assembly and it will be described briefly to aid in an understanding of how the bobbin changing apparatus must unlatch the bobbin casing 15 from the thread shuttle 25 and pull the bobbin assembly from the thread shuttle before inserting a new bobbin assembly into the thread shuttle.

The oscillating thread shuttle 25 includes a central support shaft 27, as best seen in FIG. 2, which is inserted through a central cylindrical hub 28 (FIG. 3) of the bobbin casing 15 to insert the free end of the shaft having a latch groove 29 into position to be latched by a latch 30 on the bobbin casing. Herein, the latch comprises a latch slide 31 and a latch lever 33 pivoted to one end of the slide by a pivot pin 32. The latch slide 31 has a central opening 34 into which is projected the latch groove 29 to receive locking edge 35 of the latch slide when the latch lever 32 is in its locked position generally flat against the outer face of the latch slide, as best seen in FIG. 2. The latch lever is pivoted by the pivot pin 32 carried at an end of the latch slide for turning about the pin to cause its bent cam end 36 to cam against an edge of a slot 37 in the end wall 43 of the bobbin casing and thereby slide laterally the latch slide and the latch lever carried thereby in a grooved slot formed in the outer wall 43 of the bobbin casing. When the latch 30 is pivoted open, a hooked end 38 on the latch slide 31 hooks onto the bobbin 14 to assure that both the bobbin and the bobbin casing are extracted simultaneously.

Heretofore, to pivot the latch slide to remove its edge 35 from the latch groove 29, an outer rounded end of the latch lever 33 was grasped by the operator's finger and pivoted outwardly with its bent end 36 camming against end wall of the slot 37 thereby sliding the latch slide to shift the edge 34 from latch groove 29. The operator would then pull the bobbin assembly from the thread shuttle shaft 27 and remove the used bobbin 14 from the bobbin casing and insert an unused bobbin having a supply of thread thereon into the bobbin casing. The bobbin 14 is generally reel-shaped having a hollow hub 39 for telescoping on the cylindircal sleeve 28 and includes a pair of opposite reel-like cylindrical flanges 44. A leading end of a thread 40 on the bobbin is threaded through an opening or eye 41 of a finger 42 on the bobbin casing by the operator before telescoping the bobbin casing sleeve onto the thread shuttle shaft and pushing the same into the thread shuttle until the latch 30 operated. The above described operation is well known in the art and is typical of Model No. 269 sewing machine made by Singer Sewing Machine Company. Manifestly, the bobbin changing apparatus described herein may be used with various sewing machines and bobbin assemblies differing from that described herein.

In accordance with the present invention, an apparatus is provided for automatically unlatching the bobbin assembly 12 from the thread shuttle 25 and for substituting a new unused bobbin assembly for the used bobbin assembly. Preferably, the substitution is initiated automatically after a predetermined number of sewing operations, such as ten butterfly stitch patterns of 168 stitches each, and during the time that another apparatus is discharging a sewn belt and inserting a new belt beneath the sewing machine. The release of the latch 30 from the support shaft 27 of the oscillating thread shuttle is achieved by an unlatching means 45 which includes a hook-shaped unlatching lever 47 having a pointed tip for engaging latch lever 33 and pivoting the same to shift the latch slide 31 to the unlatching position in which the opening 34 in the latch slide is aligned with shaft 27 to allow the bobbin assembly 12 to be pulled from the thread shuttle shaft 27. The bobbin casing must be pulled in a direction parallel to the axis of the shuttle shaft 27 to prevent binding of the bobbin casing sleeve 28 on the shuttle shaft 27. To pull the bobbin assembly from the shuttle shaft, the bobbin casing is gripped with a finger-like action between a hooked end 62 of an unlatching lever 47 and an outer free end of a plunger 50. The extracted bobbin assembly is transferred from the oscillating thread shuttle 25 into an open receptacle or cavity 52 in a magazine 54. The magazine has one empty receptacle for receiving the latest used bobbin and a plurality of bobbin assemblies in downstream receptacles 52. A magazine is preferred to have at least one and preferably more bobbin assemblies therein for transfer to the thread shuttle. Herein, is a linear bar shaped magazine which first receives a spent bobbin assembly in a receptacle 52 and then is indexed linearly to shift an unused bobbin assembly into alignment with the plunger 50 which is then actuated in the opposite pushing direction to push the assembly from the magazine and into the thread shuttle. The plunger causes the latch 30 to snap into latching engagement with the shaft 27, completing the bobbin changing operation in a short period of time. As will be explained in greater detail, in the preferred bobbin changer, a new magazine may be inserted behind the active magazine and it will automatically be shifted into position as the prior magazine is spent so that there will not be any time lost to change magazines.

As will be explained in greater detail, the bobbin changing operation occurs automatically after a predetermined count for example, after a count of ten sewing operations, and is made quickly during the time interval during which a sewn belt is being discharged and a new belt is being positioned beneath the sewing needle. Thus, the sewing machine need not be idle for a separate period of time for a bobbin changing operation as is the case when the bobbin changing operation is done manually by the operator.

Referring now in greater detail to the illustrated embodiment of the invention, the unlatching means preferably comprises an unlatching lever means 47 and an actuating means 59 therefor. To pivot the latch lever 33 outwardly, the actuating means 59 swings the unlatching lever 47 to hook its hooked end 62 behind the inner facing end of the latch lever about its pivot pin 32 to unlatched position which is shown in solid lines in FIG. 3 in which the latch slide opening 34 is aligned with the shaft 27 and with the edge 35 of the latch slide removed from the groove 29 on the shaft 27. The unlatching lever 47 comprises the upper lever 63 having the outer pointed hooked end 62 and an inner end fixed to a vertical extending pin 64 (FIG. 7) which extends downwardly through a cylindrical sleeve portion 66 of a support bracket 65 to a lower end which is fastened by a set screw 67 to a lower lever 69. The lower lever 69, as best seen in FIG. 6, includes a cross portion 70 which is fixedly connected by a pin 71 to a clevis 73 attached to an outer end of a piston rod 75 for the actuating cylinder 77 of the actuating means 59. The support bracket 65 is secured to a shiftable carrier 81 which also carries the plunger 50, as will be described in detail hereinafter, by a bracket plate 80 which is fixed at one end to the cylindrical sleeve portion 66 and fixed at the other end to the underside of slide block 95 of the carrier 81.

Operation of the pneumatic actuation cylinder 77 to retract the piston rod 75 swings the lower lever 69 clockwise as viewed in FIG. 6 to turn the pin 64 in the sleeve portion 66 and thereby pivot the upper lever 63 clockwise thereby causing hooked end 62 to engage and swing the latch lever 33 sliding the latch slide 31 from the latched position to the unlatched position. As best seen in FIG. 4, the actuating cylinder 77 is secured by a bracket 86 and fasteners 87 to one side of the carrier slide block 95 and at an angle to the latter. The upper lever 63 is also at an angle to a true horizontal plane as is evidenced by the inclination of a slot 89 (FIG. 5) in the magazine 54 through which the lever 63 passes in order to engage the bobbin casing. The outer free end of the plunger 50 passes through the receptacle opening 52 as the upper lever 63 passes through the slot 89, both the upper lever 63 and the plunger being carried by the slide block 95 for fore and aft movement, as will be described.

At the time of extraction of the used bobbin 14, the plunger 50 will have been inserted through the open receptacle 52 to bring its leading end 91 into position for abutment with the end face wall 43 of the bobbin casing 15. An inclined slot 93 (FIG. 6) is formed in the end of the plunger 50 to receive therein the outwardly pivoted latch lever 33 and the hooked end 62 of the unlatching upper lever 63. A cross slot 92 (FIG. 6) admits the point of the hooked end when the latch lever 33 has been pushed against plunger slot wall 94. A corner relief 90 on the end of the plunger is aligned to receive therein a portion of the bobbin casing finger 42. The hooked end 62 holds the latch lever 33 against a plunger slot wall 94 and the plunger and lever form a pinched or closed finger for grasping the latch lever so that as the carrier 81 moves away from the thread shuttle 25, the captured bobbin assembly will be extracted therefrom.

The carrier 81 for shifting the bobbin assemblies, plunger 50 and unlatching lever 47 comprises the slide block 95 which is guided for fore and aft movement along a pair of spaced parallel stationary guide rods 96. A central portion of the slide block is connected to an outer end of the piston rod 97 of a carrier actuating means 99. The carrier actuating means includes a pneumatic air cylinder 100 disposed with its axis disposed horizontally and secured by fasteners 101 to a right angle-shaped mounting block 102 which is fixed to an underlying plate 103. The parallel guide rods 96 are secured at one end to the upstanding block portion 105 of the mounting block 102.

The grasp of a bobbin assembly between the plunger 50 and the unlatching lever 47 is released mechanically by the cam release arm 57 on the lower lever 69 as it abuts a front upstanding wall 107 of the block portion 105 and swings the hooked end 62 outwardly from the plunger slot 93. The upstanding wall 107 is positioned at a predetermined spatial relationship with respect to the magazine bar 54. And the cam release arm 57 is of such a length that it engages the wall 107 and swings the hooked end 62 from the latch lever as the bobbin assembly becomes seated in the receptacle 52. Therefore, as the carrier continues to move aft, the tip 111 of the cam release arm slides along the wall 107 with a concomittant counterclockwise pivoting of the hooked end 62 from contact with the latch 30 leaving the bobbin assembly behind. The actuating cylinder 77 is also actuated to retract its piston rod 75 and thereby pivot the hooked end 62 counterclockwise, as the bobbin casing 15 is seated in a magazine receptacle. As the carrier travels rearwardly, the forward end of the plunger 50 shifts rearwardly of the magazine bar 54 to a position spaced therefrom, as shown in FIG. 8. With the plunger and unlatching lever means withdrawn from the magazine 54, it is possible to index it, as will be explained hereinafter.

The magazine 54 carries a number of bobbin assemblies, such as, for example, six bobbin assemblies with a receptacle 52 being emptied to receive a previously used bobbin when the magazine is first inserted into operative relationship with the unlatching means and the bobbin transfer means.

The magazine 54 which holds the bobbin assemblies 12 is preferably in the form of a removable elongated, solid, bar-shaped body 113 which has been preloaded with a bobbin assembly in each of the receptacles 52 except for the leading one of receptacles which is left empty to receive the used bobbin assembly from a preceding magazine. Several magazines are kept loaded and handy at all times with the thread having been threaded through the eye 41 of the bobbin casing finger 42 for each bobbin assembly in a magazine 54. The preferred receptacles 52 are cylindrical apertures slightly larger in diameter than that of the bobbin casing 15 and are formed with an annular interior stop shoulder 115 defined at the junction of a smaller diameter bore portion 117 of the receptacle with a large diameter portion 118 which receives the bobbin casing. The stop shoulder will limit the rearward retractive movement of a bobbin assembly by the retractile movement of the unlatching lever 47 and plunger 50. Each bobbin assembly is held against the stop shoulder 115 and from vibrating from a receptacle by a retaining means which herein includes a detent means such as a Vlier pin which is a spring biased ball plunger assembly 119. More specifically, the ball plunger assembly 119 comprises an internal spring 121 which urges a ball 122 to project through a small aperture opening in the magazine body 113 at the bottom of the bobbin receptacle 52. The depressed ball holds the bobbin casing with sufficient detenting or holding force to retain the bobbin within the magazine body as it is handled and also during the indexing of the magazine when it is in position for use. As best seen in FIG. 8, the retention of the bobbin assemblies in the magazine is further aided by a pilot bar flange 141 which projects into a longitudinally extending channel 151 in the magazine bar along the upper portion of each receptacle 52. The pilot bar flanges do not extend to cover the receptacle aligned with the plunger 50.

The magazine body 113 is guided for rectilinear movement along forward and rearward guide rails 124 and 125 each of which has a triangular cros-sectioned rail section 129 for sliding within triangular shaped grooves 131 milled in opposite longitudinally extending side walls 133 and 134 of the body 113. The triangular shaped grooves 131 extend the full length of the magazine body whereas the respective guide rails 124 and 125 are formed of first and second sections having a central and spaced opening at the location of the plunger 50 and the unlatching lever 47.

To assist in accurately locating the magazine 54 which the axis of the bobbin assembly 12 coaxial with the plunger 50 and with the axis of the thread shuttle 25, the magazine bar body 113 is provided with a registering or locating means 137. Herein, the registering means comprises precisely located detent seats 139 in the form of small circular holes formed in vertical side walls 133 and 134 of the magazine bar for receiving therein a ball 143 of a ball plunger 144 mounted in support guide rails 124 and 125. The detent ball plungers likewise have an internal spring forcing the ball outwardly to roll against the sides 133 and 134 of the magazine body 113 until a seat 139 is reached at the end of an indexing step for the magazine 54. Preferably, there is one detent seat 139 for each bobbin receptacle 52 with all of the detent balls being operative at the termination of an indexing movement to hold the bobbin assembly at the transfer station in an aligned coaxial position with the plunger 50 and the axis of the osciallating thread shuttle 25.

The respective magazine guide rails 124 and 125 are supported on vertically extending, spaced brackets 145 which are secured at their lower ends to the base plate 103. The brackets for the forward guide rail 125 also support a pair of pilot plates 147 which have horizontally extending flanges 141 for insertion into a longitudinally extending pilot channel 151 formed in the forward side wall 134 of the magazine body 113. The pair of pilot plates 147 are separated at the transfer locations of the bobbin casing so as not to interfere with the transfer of the bobbin assembly to or from the magazine bar. The other side 133 of the magazine body 113 lacks a similar pilot channel so that the cartridge bay may not be put in backwards into the machine with the small diameter portion 117 of the receptacle openings facing the thread shuttle. That is, it is necessary to align the pilot channel 151 with the pilot flange 141 before a new magazine may be slid along the guide rails 124 and 125 for support thereby. As stated above, the pilot plates hold the bobbin casings in the magazine to prevent the vibrating out of the bobbin casings from the magazine bar.

To index the magazine 54, there is provided an indexing means 153 which herein comprises an indexing pawl means 155 which co-operates with index teeth 156 on the lower side 157 of the cartridge body 113. An index tooth 156 is located beneath each bobbin receptacle 52 and a single indexing movement of the pawl means is all that is needed to shift one bobbin receptacle 52 from the transfer station and to shift the next bobbin receptacle 52 into the transfer station.

As best seen in FIGS. 5, 8, 9 and 10, the indexing pawl means 153 includes a pair of pivotally mounted pawls 157 and 158 each of which has upper pointed tips 159 for abutting a tooth wall 156 formed on the left side of a groove 160 formed in the bottom side of the magazine. The pawls 157 and 158 push the magazine 54 as their common pawl carrier 161 is pulled to the left as viewed in FIG. 5. The pawl carrier 161 is connected to a pneumatic cylinder 163 which is suitably mounted by brackets 162 to the base plate 103. Herein, the cylinder axis is generally parallel to the feed direction and the cylinder's piston rod 167 is connected to the pawl carrier 161 to move the same through a predetermined stroke, for example, two inches each time the cylinder's piston is retracted to shift the magazine 54 to the left as viewed in FIG. 5.

The pawl carrier 161 comprises a cylindrical, horizontally extending rod 170 coaxial with and fixed to the outer free end of the piston rod 167. The rod 170 is projected through openings in pillow blocks 172 and 173 secured at their lower ends to base plate 103. Secured to the rod 170 and projecting laterally from the rod 170 to the location of the magazine bar tooth wall 156 are a pair of pawl supports 175, which are best seen in FIGS. 8 and 9. The outer ends of pawl supports are formed with upstanding spaced flanges 177 and 179 spaced apart to allow the pawls 157 and 158 to be guided therebetween for pivotal movement about their pivot pins 180 projecting through an opening in the upper end of the pawl and into the flanges 177 and 179.

Herein, the pawls 157 and 158 are one-way pawls which have longer weighted lower ends 182 which extend downwardly to hold the pawl tips 159 upwardly for engagement with a tooth. Each of the pawls is pivoted adjacent its upper end by a horizontally extending pin 180 in the pawl carrier. The upper surfaces of the pawls adjacent their pawl tips 159 are provided with inclined cam surfaces 185 (FIG. 10) which will abut a cam wall 186 on the magazine bar as the pawl carrier moves in the return direction. That is, the cam walls 186 on the stationary magazine bar hit the cam surfaces 185 on the pawls moving in a rearward direction (to the left as viewed in FIG. 10) and pivot the pawls counterclockwise, as viewed in FIG. 10, to lower the tips 159 without shifting the magazine bar 113. When the return stroke of the extended piston repositions the pawls beneath another tooth opening, the pawl tips 159 will again swing upward by means of the lower weighted ends 182 and be in position to abut sidewalls 156 of the magazine bar. On the retraction of piston rod 167, the pawls abut a stop wall 190 which prevents their turning in the clockwise direction during indexing of the magazine bar.

Referring now in greater detail to the preferred and illustrated pneumatic control means, after the sewing machine completes each operation of sewing, for example, a butterfly stitch, it operates a limit switch 200 in an air line 201 which passes air from air line 199 to a counter logic element 203 which passes an impulse of air to actuate the pneumatic counter 205 for an additional count. In this manner, the counter 205 is actuated each time the sewing machine completes a sewing operation. The counter 205 passes an air pulse out over an output air line 207 after a predetermined count (ten) has been reached to initiate the bobbin changing operation. The air is supplied from an air source 196 through a filter and regulator 197 to air line 199 and the power air is passed through a lubricator 198 to a line 225 which will supply the power air for operating the pneumatic cylinders 100, 77 and 163.

In the illustrated embodiment of the invention, the sewing of the 10th belt causes the counter to operate to a position to allow air to flow from line 206 through the counter 205 to output line 207 in which is a manually operable switch 209. Line 207 passes air to a differentiating logic element 211 which provides an air pulse over line 213 to flip-flop logic element 214 connected by a line 215 to "Not" logic element 217 which in turn is connected to OR logic element 219. The latter is connected by line 221 to a control valve 223 for the carrier cylinder 100. Control valve 223 is spring biased to an OFF position at which it is exhausted to atmosphere. Air flow from OR logic element 219 shifts the valve 223 to its ON position and air from power air line 225 passes through the control valve 223 to line 227 to operate the carrier cylinder 100 to shift the carrier 81 which then moves the unlatching lever 47 and the plunger 50 to a position in front of the spent bobbin.

To grip the bobbin casing, air from line 215 passes over line 229 to a delay logic element 231 which is in line 233 leading to "Not" logic element 235. Air passes through "Not" logic element and over line 237 to operate a control valve 239 to its "On" position in which power air passes from line 241 which is connected to power air line 225, to operate the cylinder 77 to close the unlatching lever 47 which pivots the hooked end 62 thereof to unlatch the bobbin casing 15 and to hold its latch lever 33 against the inclined surface 94 of the plunger 50. Thus, the latch casing is gripped for removal from the thread shuttle 25 in the sewing machine.

To cause retraction of the bobbin casing 15 from the thread shuttle 25, air from line 233 is also delivered over line 242 to a delay logic element 243. Air passes through the latter over line 245 to "Not" logic element 217 to inhibit the same thus allowing the spring returned control valve 223 to return to its OFF position in which line 227 is exhausted through valve 223 to atmosphere. Simultaneously, control valve 246 is shifted by this air flow over line 221 to its ON state to connect power air from lines 225 and 247 to line 248 which then actuates the plunger cylinder 100 to return the carrier 81 to seat the bobbin casing 15 in the aligned and empty receptacle 52 in the magazine bar and to return the plunger 50 rearwardly of the magazine bar.

The delay 243 supplies air over line 250 to another logic delay element 249. The latter causes unlatching lever to release the bobbin casing 15 by passing air over line 251 to "Not" logic element 235 to inhibit the same and allowing spring biased control valve 239 to return to an OFF position to exhaust one side of the cylinder 77 while simultaneously shifting the other control valve 253 to an ON position to pass air from the lines 255 and 225 through valve 253 to deliver the pressurized power air over line 257 to the other side of the unlatching lever's actuating cylinder 77 which then operates to open the hooked end from its position behind the bobbin casing latch. Thus, the bobbin casing is released when seated within the receptacle 52 in the latch bar magazine.

Air delivered to the line 251 from the delay 249 also passes over line 259 to a further delay 261 which is connected to a "Not" logic element 263. "Not" logic element 263 passes air over line 265 to a spring biased, control valve 267 which then shifts to an "On" position to allow power air to flow therethrough from line 269 and over line 270 to the magazine indexing cylinder 163 to extend its piston rod to shift the pawls 157 and 158 to new teeth surfaces 156 preparatory to indexing the magazine on the retraction of the piston rod 167.

To retract the piston rod, air from the delay 261 and line 271 is passed through delay 273 which passes air over line 275 and line 277 to "Not" logic element 263 to inhibit the same. Thus, the control valve 267 will shift to its "Off" exhaust position and the lack of air in line 279 allows spring biased control valve 281 to return to its "Off" position in which power air flows through the control valve 281 and over line 280 to operate the stepping mechanism cylinder 163 to retract piston rod 167 and the stepping pawls 157 and 158 which shift the magazine to position a new and full bobbin in alignment for transfer to the oscillating shuttle 25.

At the time of shifting the magazine, air in line 279 also was passed to reset side of the counter 205. Counter 205 is reset to begin a new count by the counter.

To shift the new bobbin casing 15 from the magazine into the thread shuttle 25 in the sewing machine, the plunger 50 is shifted forwardly by the carrier as the cylinder 100 is actuated. To this end, air from line 275 flows over line 278 to OR logic element 219 to shift the control valve 223 to its "On" position to allow power air to pass therethrough to extend the piston in the cylinder 100 causing plunger 50 to travel through the receptacle 52 in the magazine and to shove the bobbin casing into the oscillating shuttle. The magazine bar is preferably so close to the thread shuttle that the bobbin casing sleeve 28 will be telescoping on the shuttle shaft 27 before the bobbin assembly is free of the magazine. The plunger 50 extends sufficiently to push the bobbin assembly onto the thread shuttle shaft 27 that the free end of the shaft 27 cams its way through the latch slide opening 34 and the spring biased latch slide 31 then snaps back to engage edge 35 of the latch slide in the latch groove on the shaft 27.

Reset of the logic circuit means of FIG. 11 will terminate air flow through OR logic element 219 allowing air control valve 246 to return to its "Off" position causing the cylinder 100 to shift the plunger in the reverse direction and from the bobbin casing. The resetting is accomplished by air from line 275 flowing over line 289 and through delay 291 through reset line 293 to the reset side of the flip-flop 214. The flip-flop 214 resets. An output signal of air from the flip-flop may then be delivered over line 295 to the sewing machine control system to indicate that the sewing operations may now commence because the bobbin changing operation and counter setting operation have been completed.

From the foregoing it will be seen that the present invention provides a bobbin changing apparatus which is automatically operated after a predetermined count of stitching operations. As explained fully in co-pending application Ser. No. 840,356 filed Oct. 11, 1977, the preferred bobbin changer operation occurs during a transfer operation of the workpiece into or from a position beneath the sewing needle of the sewing machine so that the bobbin changing operation is relatively time free with respect to the sewing time cycle of the sewing machine. In this manner, the sewing machines may be operated almost continuously between the transfer operations without having to have a separate shutdown of the sewing machines in order to have a bobbin changing operation.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. An automatic bobbin changing apparatus for a sewing machine having a thread shuttle for receiving a bobbin assembly including a bobbin casing latched by a latch to a shaft of the thread shuttle and including a thread carrying bobbin in said bobbin casing, said apparatus comprising means for unlatching the bobbin casing from the shaft of said thread shuttle, means for extracting the used and unlatched bobbin assembly from the thread shuttle and for substituting therefor a new and unused bobbin assembly, a magazine means having receptacles therein for receiving a used bobbin from said extracting means and for holding unused bobbin assemblies for replacing a used bobbin assembly, control means for operating said unlatching means and said means for extracting the used bobbin assembly and for substituting the new bobbin assembly therefor, an index means for stepping said magazine means after receiving a used bobbin assembly therein to present a used bobbin assembly in said magazine for transfer to the thread shuttle, said magazine comprising an elongated bar-shaped cartridge having a linear array of receptacles therein said indexing means indexing the cartridge to present a new bobbin assembly to a transfer station for transfer to said shuttle, and a registering means engaging said magazine and aligning the axis of a receptacle with the axis of the thread receiving shuttle of the sewing machine.

2. An apparatus in accordance with claim 1 in which a means engages and co-operates with said magazine to prevent a reverse orientation of said magazine.

3. An apparatus in accordance with claim 1 in which said unlatching means comprises a pivotally mounted lever having a hooked end for hooking the latch and for pivoting it to an open position.

4. An apparatus in accordance with claim 3 in which said means for extracting the bobbin assembly includes a plunger having an end for abutting the bobbin assembly and for co-operation with said hooked end of said lever to grip said bobbin assembly for pulling the same from the shaft of the thread shuttle.

5. An apparatus in accordance with claim 4 in which an inclined surface on said plunger is engaged by the opened latch lever and in which said hooked end holds said latch lever against said plunger inclined surface during the extraction of the bobbin assembly.

6. An apparatus in accordance with claim 5 in which said extracting and substituting means includes a carrier means carrying said unlatching lever and said plunger and carries them for fore and aft movement relative to said thread shuttle.

7. An apparatus in accordance with claim 6 in which a release means swings said hooked end from said bobbin assembly to release the grip on the same when the used bobbin assembly has been returned to a receptacle in said magazine means.

8. An apparatus for automatically changing bobbin assemblies comprising a bobbin in a bobbin casing in a thread shuttle having a supporting shaft in latched engagement with a latch slide operated by a latch lever on the bobbin casing, said apparatus comprising an unlatching lever means having a hooked end for engaging the latch lever and pivoting the same to an open inclined position to cause the latch slide to shift to an unlatched position from the shuttle shaft, a plunger means having a surface for engaging the bobbin casing and for co-operative relationship with the unlatching lever to grip the used bobbin assembly and to pull the same from the shaft on the thread shuttle, a carrier means for carrying said plunger and unlatching lever in a direction from the thread shuttle, a magazine means having a plurality of receptacle openings therein with an open receptacle aligned to receive the used bobbin assembly, means for indexing the magazine means to position an unused bobbin assembly at a transfer station, means for actuating said carrier means to move said plunger to transfer the unused bobbin assembly at the transfer station into the thread shuttle, said plunger being mounted for movement through said receptacle opening in said magazine means.

9. An apparatus in accordance with claim 8 in which said unlatching lever means is mounted at an angle to the axis of said plunger and in which slots are provided in said magazine to allow movement of said unlatching lever through said magazine.

10. An apparatus for automatically changing bobbin assemblies comprising a bobbin in a bobbin casing in a thread shuttle having a supporting shaft in latched engagement with a latch slide operated by a latch lever on the bobbin casing, said apparatus comprising an unlatching lever means having a hooked end for engaging the latch lever and pivoting the same to an open inclined position to cause the latch slide to shift to an unlatched position from the shuttle shaft, a plunger means movable along a path coaxial with said shuttle shaft and having a surface for engaging the bobbin casing and for co-operative relationship with the unlatching means to grip the used bobbin assembly and to pull the same from the shaft on the thread shuttle, a carrier means for carrying said plunger and unlatching means in a direction from the thread shuttle, a magazine means having a plurality of receptacle openings therein with an open receptacle axially aligned with said shaft to receive the used bobbin assembly, means for indexing the magazine means to position an unused bobbin assembly at a transfer station, and means for actuating said carrier means to move said plunger to transfer the unused bobbin assembly at the transfer station into the thread shuttle.

11. An apparatus for automatically changing bobbin assemblies comprising a bobbin in a bobbin casing in a thread shuttle having a supporting shaft in latched engagement with a latch slide operated by a latch lever on the bobbin casing, said apparatus comprising an unlatching lever means having a hooked end for engaging the latch lever and pivoting the same to an open inclined position to cause the latch slide to shift to an unlatched position from the shuttle shaft, a plunger means having a surface for engaging the bobbin casing and for co-operative relationship with the unlatching lever to grip the used bobbin assembly and to pull the same from the shaft on the thread shuttle, a carrier means for carrying said plunger and unlatching lever in a direction from the thread shuttle, a magazine means having a plurality of receptacle openings therein with an open receptacle aligned to receive the used bobbin assembly, means for indexing the magazine means to position an unused bobbin assembly at a transfer station, means for actuating said carrier means to move said plunger to transfer the unused bobbin assembly at the transfer station into the thread shuttle, and an indexing means for indexing the magazine and comprising a pawl means for stepping the magazine.

12. An apparatus for automatically changing bobbin assemblies comprising a bobbin in a bobbin casing in a thread shuttle having a supporting shaft in latched engagement with a latch slide operated by a latch lever on the bobbin casing, said apparatus comprising an unlatching lever means having a hooked end for engaging the latch lever and pivoting the same to an open inclined position to cause the latch slide to shift to an unlatched position from the shuttle shaft, a plunger means movable along a path coaxial with said shuttle shaft and having an inclined surface for cooperative gripping relationship with the hooked end of said unlatching lever to grip the latch lever, a carrier means for carrying said plunger and unlatching lever means in a direction from the thread shuttle, means for shifting said hooked end of said lever to said gripping relationship with said inclined surface, a release means for swinging said hooked end from said inclined surface and the latching lever, an end wall on said plunger means for pushing a new unused bobbin assembly into said thread shuttle, and means for shifting said carrier means toward and from said thread shuttle.

* * * * *